United States Patent [19]

Balster

[11] 4,185,956

[45] Jan. 29, 1980

[54] GAS PERMEABLE STRUCTURAL PART

[75] Inventor: Hugo Balster, Beckum, Fed. Rep. of Germany

[73] Assignee: Readymix Cement Engineering GmbH & Co. KG, Ratingen, Fed. Rep. of Germany

[21] Appl. No.: 880,185

[22] Filed: Feb. 22, 1978

[30] Foreign Application Priority Data

Feb. 24, 1977 [DE] Fed. Rep. of Germany ..... 2707953

[51] Int. Cl.[2] ..... F27D 5/00

[52] U.S. Cl. ..... 432/258; 126/167; 432/261

[58] Field of Search ..... 432/258, 261; 126/151, 126/155, 158, 162, 167

[56] References Cited

U.S. PATENT DOCUMENTS

| | | | |
|---|---|---|---|
| 1,601,388 | 9/1926 | Decker | 126/155 |
| 2,834,593 | 5/1958 | Hudson | 432/261 X |
| 3,589,694 | 6/1971 | Gelling et al. | 432/261 |

*Primary Examiner*—John J. Camby

*Attorney, Agent, or Firm*—Martin A. Farber

[57] ABSTRACT

A gas permeable structural part, particularly for use in burning and sintering devices, for withdrawal preferably of hot gases from a layer of granular material with a group of rods arranged parallel to one another and spaced from one another, which rods form a gap respectively therebetween, the gap width being smaller than the diameter of the smallest material granule. The grid rods have the smallest possible cross-section, and extend as short as possible in a direction perpendicularly to the surface of the structural part, solely assuming the mechanical pressure of the material loading the grid rods without deformation. The grid rods are supported on carrier rods which extend approximately perpendicularly thereto, the carrier rods being formed with a short width and a considerably larger depth and are arranged at such a distance from one another that they assume the total mechanical and thermal forces which load the structural part and they subdivide the grid rods which engage thereon into individual sections with sufficiently short buckling length with respect to their total load.

13 Claims, 9 Drawing Figures

Figure 1:
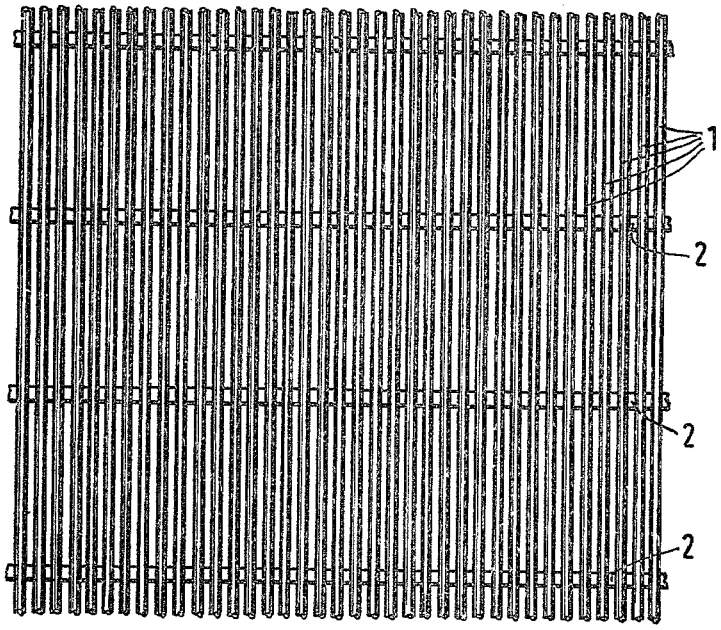

Fig.8
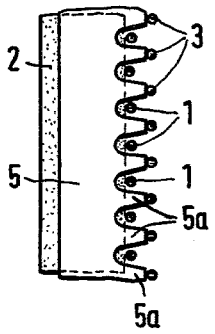
Fig.6
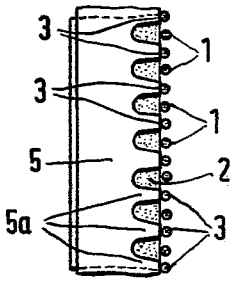
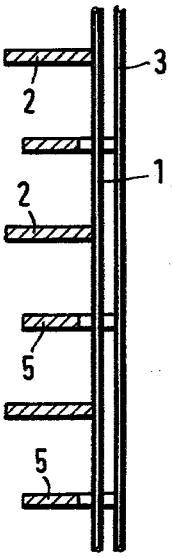
Fig.9
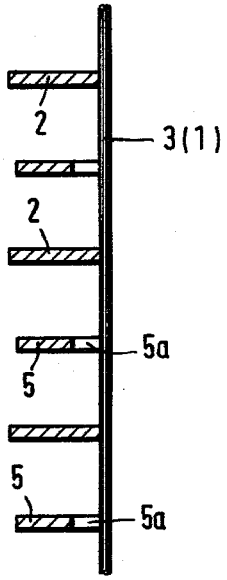
Fig.7

GAS PERMEABLE STRUCTURAL PART

The invention relates to a gas permeable structural part, particularly for use in burning- and sintering devices, for removal preferably of hot gases from a layer of granular material with a group of rods arranged parallel to one another and spaced from one another, which rods form a gap respectively between themselves, the gap width of which is smaller than the diameter of the smallest material granule.

Gas permeable structural parts of the previously mentioned type are known. They are used particulary on furnaces for burning or sintering of cement, lime, magnesite, dolomite or similar substances, and indeed as a stationary structural part in a vertical or inclined arrangement, as well as also a moveable structural part, for example on sliders which are moveable in a horizontal direction.

With the known formations the gas permeable structural part is formed by rods secured with their ends on a frame, which have a frustoconical cross-section, the larger base surface of which faces the material layer to be deposited. Between such fixed rods there are arranged additional rods with a square cross-section, which latter rods respectively together with the two adjacent rods with frustoconical cross-section form gaps and are moveable in the lengthwise direction for cleaning of the gas permeable structural part.

This known construction of a gas permeable structural part has the disadvantage that it opposes a high-resistance to the gas to be drawn off, since in relationship to the total surface of the structural part, the sume of the gaps amount to a comparatively small surface. Because of the large extension of the rods in the flow-through direction of the gas, the known embodiment beyond that is inclined to clog or obstruct.

It is a task on which the present invention is based to provide a gas permeable structural part of the introductory described type which avoids the disadvantages of the known constructions and is to have a simple and light construction with the smallest possible reduction of cross-sectional area through or by the rods, which with smallest possible deformation of the rods by the action of heat eliminates the settling of material in the gaps.

This task objective is solved with the invention in the manner that the grid rod have a smallest possible cross-section, which cross-section with a smallest possible extension in a direction perpendicular to the surface of the structural part solely assumes the mechanical pressure of the material loading the grid rods, without deformation, and that the grid rods are supported on carrier rods running approximately perpendicularly to them, which carrier rods are formed with small width and considerably larger depth and are arranged at such a distance from one another that they assume the total mechanical and thermal forces loading on the structural part and they subdivide the grid rods which engage thereon into individual sections with sufficiently short effective column length or buckling length with respect to their total load.

With this proposal of the invention a gas permeable structural part is produced, whose decrease in cross-sectional area through or by the rods and by the material of the construction of the structural part, respectively, is so small as possible such that the gas permeable surface formed by the gaps attains a greatest possible value; in this manner extremely high air speeds are avoided which with the known construction led to a strong pressing of the granular material against the structural part and consequently led to an increasing clogging of the same. A settling of granular matter in the gaps of the structural part in accordance with the invention is prevented in the manner that the extension of the grid rods in the flow-through direction of the gas is very small; as a result of this formation granules penetrating between adjacent grid rods are transported through the gas permeable structural part very rapidly by following material, so that clogging is avoided. Such type of clogging with the known construction of a gas permeable structural part leads to an additional increase of the flow-through speed of the gas and in this manner causes an increase of the clogging tendency. By means of the engagement or contact of the grid rods on the carrier rods, with the formation in accordance with the invention of the gas permeable structural part it is possible to form the grid rods with the smallest possible cross-section; this is achieved on the one hand in the manner that the carrier rods assume the main load of the gas permeable structural part so that the grid rods function essentially for formation of the gaps, and on the other hand however first make it possible in the manner that the carrier rods subdivide the grid rods engaging on them in comparatively short sections, the effective column length of which is so small with respect to the total length of the grid rods such that they can assume all loads without deformations and thus changes of the gap widths.

According to a further feature of the invention the grid rods have a circular cross-section. In this manner surfaces are avoided inside of the gas permeable structural part, which surfaces run parallel to each other in the direction of flow of the gas, which surfaces promote clogging by material granules which have penetrated into the gaps. The circular cross-section of the grid rods according to the invention not only prevents clogging, but also as a result has a self-cleansing action of the gas permeable structural part, since the material layer which moved along the structural part with respect to the cross-sectional formation of the grid rods loosens material granules which wedged between the latter and carries them along.

The carrier rods according to a further feature of the invention are formed with a rectangular cross-section with a small width and a larger depth, in order on the one hand to produce a smallest possible reduction of cross-sectional area of the gas permeable structural part and on the other hand to guarantee the necessary stability. With a preferred embodiment the grid rods and the carrier rods are welded to each other at the crossing points, whereby this welding can be performed by spot welding, electro-welding, autogenous welding, Wolfram-inert gas welding (TIG welding), or similar welding methods.

In case the gas permeable structural part is inserted in zones of higher temperature, according to a further feature of the invention the grid rods and the carrier rods can be made of a temperature resistant material unaffected by temperature changes. With very high heat loads moreover it is possible to construct the grid rods and/or the carrier rods with a hollow cross-section and to provide them with at least one feed conduit for a gaseous or liquid coolant which is transported through the hollow cross-section in the desired quantity. According to a further feature of the invention also cooling tubes for a gaseous or liquid coolant can be arranged on the carrier rods.

With the invention it is further proposed to arrange each second grid rod on a group of supplementary carrier rods, which are moveable relatively to the carrier rods. By this further development of the main concept of the invention it is possible at least temporarily to enlarge the gaps of the gas permeable structural part by means of a relative movement of adjacent grid rods to one another, in order under the circumstances if necessary to surely remove material which has caked together. The supplementary carrier rods in this case either can be arranged on the side of the grid rods opposite to the carrier rods or on the same side of the grid rods as the carrier rods, whereby in the latter case the supplementary carrier rods are provided with projections for securing the corresponding grid rods, which makes possible the necessary relative movement.

Figure 2:
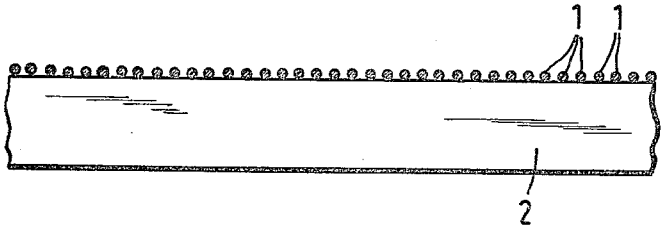
Figure 3:
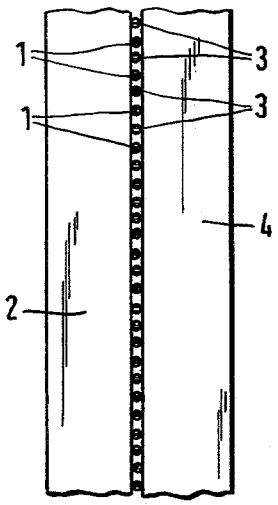
Figure 4:
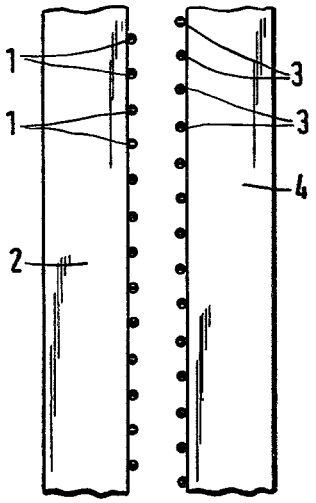
Figure 5:
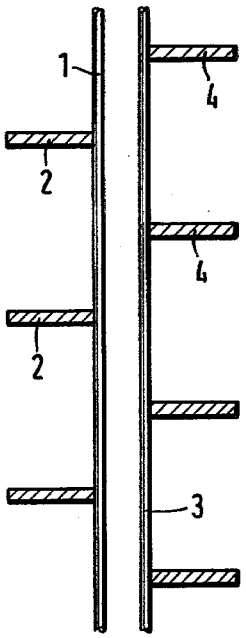

Three embodiment examples of the gas permeable structural part according to the invention are schematically illustrated on the drawing, and indeed show:

FIG. 1—a front view of a first embodiment,

FIG. 2—a front elevational view of FIG. 1,

FIG. 3—a front elevational view of a second embodiment in the normal position corresponding to FIG. 2, FIG. 4—a view corresponding to FIG. 3 in the cleaning position, FIG. 5—a side cross-sectional view of FIG. 4, FIG. 6—a front elevational view of a third embodiment in the normal position, FIG. 7—a side view of FIG. 6, FIG. 8—a cross-sectional view corresponding to FIG. 6 in the cleaning position and FIG. 9—a side view of FIG. 8.

With all three of the embodiments illustrated in the drawings the gas permeable structural part comprises grid or grating rods 1 spaced from one another as well as extending parallel to one another, and carrier or support rods 2 extending perpendicularly to the latter. The grid rods 1, which between themselves form gaps of predetermined gap width, with the illustrated embodiment examples, have a circular cross-section. The carrier rods 2, which likewise are arranged parallel to one another, are arranged however at a far larger spacing from one another, have a rectangular cross-sectional profile which extends with a short width parallel to the grid rods 1 and have a considerably larger depth.

The width of the gaps formed by the grid rods 1 is smaller than the diameter of the smallest material granule which is to be held back or retained by the structural part. By the small cross-section of the grid rods 1, the gas permeable structural part has a smallest possible reduction of cross-sectional area or necking for the gases to be drawn off through the structural part. Thereby the increase of the flow speed of the gas which is brought about by the structural part is held as small as possible. This is of significance among other things for the obstruction or clogging tendency of the gas permeable structural part, which increases with increasing gas penetration speed. The circularly shaped cross-section of the grid rods 1 prevents a jamming of material granules between the grid rods 1, because of the absence of gap walls running parallel to one another, since granules arriving between the grid rods 1, because of the small extension of the grid rods 1 in the flow-through direction either are pushed through the structural part or are dissolved out and carried along by the material moving over the grid rods 1 as a consequence of the rounded-off supporting or engaging surface of the grid rods 1.

Whereas the grid rods 1 are essentially used for the formation of the gaps, and merely without deformation must assume the mechanical pressure of the material which loads the grid rods 1, the total load of the gas permeable structure part is assumed by the carrier rods 2.

In addition to this, due to their upright or edgewise standing profile, these carrier rods 2 are suitable in spite of a comparatively large spacing from one another, whereby the small flow-against cross-section of the carrier rods 2 insures for this that the gas permeability of the structural part is only insubstantially impaired by the carrier rods 2. A further important function of the carrier rods 2 resides in that they subdivide the continuous passing grid rods 1 with respect to their loadability in individual sections with short buckling length or effective column length, so that the grid rods 1 in spite of their small cross-section can resist the mechanical as well as the thermal loads without producing deformations leading to enlargements or contractions of the gaps.

With the second embodiment example according to FIGS. 3 to 5 only each second grid rod 1 is fastened on the carrier rods 2, the latter disposed parallel to each other. The grid rods 3 which lie between the grid rods 1 are located on supplementary carrier rods 4, the latter being arranged on the other side of the grid rods 1 and 3 parallel to each other and preferably parallel to the carrier rods 2. These supplementary carrier rods 4 in the flow-through direction of the gas can be arranged either off-set or displaced relative to the carrier rods 2, as this is illustrated in FIG. 5, or also can lie behind the carrier rods 2 in the flow direction.

As may be recognized from FIG. 3 by the previously described second embodiment a gas permeable structural part is provided corresponding to the first embodiment. This embodiment however has the advantage that it can be transferred from the normal position in FIG. 3 into a cleaning position according to FIGS. 4 and 5, in which the supplementary rods 4 with the grid rods 3 are slightly removed apart from the carrier rods 2 with the grid rods 1. In this manner an enlargement of the gap width is produced which not only releases granules of matter which are stuck or jammed in between the grid rods 1 and 3, but also destroys agglomerations of material and in this manner facilitates a simple and complete cleaning of the gas permeable structural part.

Also with the third embodiment according to FIGS. 6 to 9 only each second grid rod 1 is secured to the carrier rods 2. The grid rods 3 lying therebetween are arranged on supplementary carrier rods 5, which lie on the same side of the grid rods 1 and 3, respectively, as the carrier rods 2. These supplementary carrier rods 5 have a recessed or comb-like front face, on the projections 5*a* of which there is secured respectively one grid rod 3. These projections 5*a* make possible a relative movement between the grid rods 1 and 3, which can be recognized in FIGS. 8 and 9, so that also with the third embodiment the cleaning effect which has been described in connection with the second embodiment can be achieved by means of a relative movement between the carrier rods 2 and the supplementary carrier rods 5.

I claim:

1. A gas permeable structural part, particularly for insertion in burning and sintering devices, for withdrawal preferably of hot gases from a layer of granular material with a group of rods arranged parallel to one another and spaced from one another, the rods forming a gap respectively therebetween, the gap width being smaller than the diameter of the smallest material granule to be retained, comprising means for holding granular material comprising a plurality of grid rods arranged parallel to one another and spaced from one another forming a gap respectively therebetween, said plurality of grid rods defining a face surface, the grid rods having a smallest possible cross-section and a smallest possible dimension in a direction perpendicular to the face surface of the plurality of grid rods, the grid rods with said cross-section and said extension solely assuming without deformation the mechanical pressure of a material loading the grid rods, a plurality of carrier rods supporting and engaging said grid rods, said carrier rods running approximately perpendicularly to said grid rods, said carrier rods are formed with a short width in a direction parallel to said face surface and having an extensively larger depth dimension in a direction perpendicular to said face surface, said carrier rods being spaced apart at a distance from one another such that said carrier rods assume the total mechanical and thermal forces loading the structural part and subdivide said grid rods engaging thereon into individual sections with sufficiently short buckling length with respect to their total load.

2. The gas permeable structural part according to claim 1, wherein said grid rods have a circular cross-section.

3. The gas permeable structural part according to claim 1, wherein said carrier rods have a rectangular cross-section with said short width and larger depth.

4. The gas permeable structural part according to claim 1, wherein said grid rods and said carrier rods are welded to each other on crossing points thereof.

5. The gas permeable structural part according to claim 1, wherein said grid rods are formed with a hollow cross-section, at least one feed conduit means for feeding a fluid coolant to said grid rods.

6. The gas permeable structural part according to claim 1, wherein said carrier rods are formed with a hollow cross-section, at least one feed conduit means for feeding a fluid coolant to said carrier rods.

7. The gas permeable structural part according to claim 1, further comprising means comprising cooling tubes, the latter are arranged on said carrier rods, said means for feeding a fluid coolant to said carrier rods.

8. The gas permeable structural part according to claim 1, further comprising means comprising a plurality of supplementary carrier rods for moving relative to said first-mentioned carrier rods in the direction perpendicular to the face surface of said plurality of grid rods, a plurality of supplementary grid rods arranged parallel to one another and spaced from one another, each of said supplementary grid rods are arranged parallel to and in the same plane as that of said first-mentioned grid rods and disposed between adjacent of said first-mentioned grid rods, respectively, and said supplementary grid rods are fixedly mounted on said supplementary carrier rods.

9. The gas permeable structural part according to claim 8, wherein said supplementary carrier rods are arranged on a side of said grid rods opposite to said first-mentioned carrier rods.

10. The gas permeable structural part according to claim 8, wherein said supplementary carrier rods are arranged on the same side of said grid rods as said first-mentioned carrier rods, said supplementary carrier rods are formed with a comb-like front face defining projections and recesses therebetween, said supplementary grid rods are fastened on said projections, respectively.

11. The gas permeable structural part according to claim 10, wherein said first-mentioned grid rods are disposed between said projections and said recesses are moved such that said first-mentioned grid rods are disposed between said recesses when said supplementary carrier rods are moved relative to said first-mentioned carrier rods.

12. The gas permeable structural part according to claim 8, wherein said supplementary carrier rods are off-set relative to said first-mentioned carrier rods.

13. The gas permeable structural part according to claim 1, wherein said carrier rods are spaced apart from each other by substantially ten grid rods.

* * * * *